US005883358A

United States Patent [19]

Brandolini et al.

[11] Patent Number: 5,883,358

[45] Date of Patent: Mar. 16, 1999

[54] CLOTHES PRESSING IRON WITH SOLE PLATE STIFFENING MEMBER AND AUTOMATIC HEATING CURRENT REDUCTION RESPONSIVE TO RELEASE OF THE GRIP

[75] Inventors: Jean-Louis Brandolini, Saint Etienne; Jean-Pierre Debourg, Lyons, both of France

[73] Assignee: SEB S.A., Ecully, France

[21] Appl. No.: 332,779

[22] Filed: Nov. 1, 1994

[30] Foreign Application Priority Data

Nov. 3, 1993 [FR] France ..... 93 13304

[51] Int. Cl.[6] ..... D06F 75/00

[52] U.S. Cl. ..... 219/258; 219/257; 38/77.1; 38/85; 38/88

[58] Field of Search ..... 219/245, 243, 219/251–252, 254–258; 38/77.1–77.9, 77.6, 77.8, 82, 85, 88–89

[56] References Cited

U.S. PATENT DOCUMENTS

| | | | |
|---|---|---|---|
| 1,430,830 | 10/1922 | Morgan | 219/257 |
| 1,449,278 | 3/1923 | Fleming | 219/257 |
| 1,969,583 | 8/1934 | Skolnik | 38/89 |
| 2,285,757 | 6/1942 | Smith | 38/77.6 |
| 2,533,995 | 12/1950 | Chapin | 38/77.6 |
| 2,553,274 | 5/1951 | Pohl | 219/251 |
| 2,612,587 | 9/1952 | Guerra | 38/81 |
| 2,673,917 | 3/1954 | Woodling | 38/82 |
| 3,098,922 | 7/1963 | Paxton | 219/254 |
| 3,852,899 | 12/1974 | Mackey | 38/77.6 |
| 4,532,411 | 7/1985 | Terraillon et al. | 219/245 |
| 4,546,235 | 10/1985 | Kolter | 219/230 |
| 4,854,059 | 8/1989 | Ronchi | 38/77.82 |
| 4,859,869 | 8/1989 | Heuwinkel et al. | 219/251 |
| 5,380,983 | 1/1995 | Cavada et al. | 219/251 |
| 5,478,984 | 12/1995 | Bouleau et al. | 219/254 |

FOREIGN PATENT DOCUMENTS

| | | |
|---|---|---|
| 973127 | 2/1951 | France . |
| 1037828 | 9/1953 | France . |
| 2523164 | 9/1983 | France . |
| 2686761 | 5/1994 | France . |
| 60-31800 | 2/1985 | Japan . |
| 4-166200 | 6/1992 | Japan . |
| 276184 | 8/1927 | United Kingdom . |
| 2199962 | 7/1988 | United Kingdom . |

*Primary Examiner*—John A. Jeffery
*Attorney, Agent, or Firm*—Pillsbury Madison & Sutro

[57] ABSTRACT

An electric steam iron for pressing fabrics, which iron includes an ironing sole plate, an electrically operated heating element disposed for heating the sole plate by converting an electric current to heat, and a switch unit for automatically reducing flow of electric current to the heating element when the iron is not in use. The sole plate is formed to have a low heat capacity, and the iron is further provided with a stiffening structure via which the sole plate is fixed in position in the iron, the stiffening structure being permeable to steam and being made of a thermally insulating material.

21 Claims, 5 Drawing Sheets

CLOTHES PRESSING IRON WITH SOLE PLATE STIFFENING MEMBER AND AUTOMATIC HEATING CURRENT REDUCTION RESPONSIVE TO RELEASE OF THE GRIP

BACKGROUND OF THE INVENTION

The present invention relates to the general technical field of apparatus employed to place a textile article, such as a garment, in proper form by subjecting it to the action of a thermal treatment and a mechanical pressing treatment.

The invention concerns an electric clothes pressing iron including a pressing sole plate and heating means associated with automatic power interruption means which are activated when the iron is halted.

In all pressing irons of the prior art, the principal component forming the carrier element of the iron is constituted by the pressing sole plate. The pressing sole plate is in thermal communication with heating means, for example a sheathed resistance, provided to heat the sole plate to a high temperature in order to accelerate the thermal exchange between the sole plate and the fabric. Known irons also include, in a conventional manner, a temperature limiter such as a thermostat, which is set to a desired temperature by the user based on the nature of the article to be pressed. During pressing cycles, the user finds it necessary to let go of the iron in order to be able to perform various operations that require the use of two hands, such as for example displacement, folding and turning of the article being pressed. During the course of these manipulation operations, the iron is posed horizontally and at a distance on an appropriate support or is posed on its end, or heel, so that the sole plate is oriented in a substantially vertical direction. In one of these positions or the other, the pressing sole plate is no longer in contact with the pressing support, or ironing board and consequently can not burn it.

In the majority of known pressing irons, the sole plate is maintained at its operating temperature even during periods when the pressing operation is interrupted in order to enable the user to perform the various manipulations enumerated above, so that the iron can be immediately placed back into operation. For safety reasons it has already been proposed on certain irons known in the prior art to associate the elements for heating the sole plate with automatic heating current interruption means which function when the iron is stationary. The supply of electric current to the heating element is generally interrupted at the end of a certain time when the iron has been stationary with the aid of movement sensors, such as electromechanical movement detectors.

Moreover, there exists certain models of dry pressing irons which include a thin sole plate. The heating time for the sole plate is reduced in order to achieve economies of energy. Such dry pressing irons include a rigid mass which increases the weight of the iron on which the thin sole plate can be fixed. Such a mass gives the sole plate excellent rigidity characteristics. It is thus possible to produce sole plates having a considerably reduced thickness.

The heavy rigid mass attached to the iron substantially reduces its manageability and causes the pressing operation to be very fatiguing. Moreover, this principal is limited only to dry irons and would be inapplicable to steam irons.

The necessity of putting the iron down from time to time, either in a vertical orientation or a horizontal orientation, in an area provided for this purpose constitutes a constraint on utilization which is viewed in a particularly negative manner by the user to the extent that it is considered to significantly prolong the pressing operation, which is already tedious. Moreover, the correct positioning of the iron in its rest position requires, in spite of everything, careful attention on the part of the user, an attention which decreases over time with fatigue and can increase the risk of burns or of dropping the iron. Finally, it is recognized that the repeated operations of placing the iron on and picking it up from a horizontal support or its heel constitute movements which strain the wrist of the user and lead to physical fatigue.

SUMMARY OF THE INVENTION

It is an object of the present invention to resolve the problems discussed above.

Another object of the invention is to provide an electric steam iron for clothes pressing whose thermal characteristics are improved in order to permit a particularly rapid cooling of the sole plate, and inversely an equally rapid heating of the sole plate to its operating temperature.

A further object of the invention is to provide an electric steam iron which can remain stationary during a pressing procedure in its working position even on the pressing support surface, or ironing board, without deteriorating, as by scorching, this support or the fabric being ironed.

Yet another object of the invention is to provide an electric steam iron in which the thermal capacity of the pressing module formed by the sole plate, the heating element and advantageously a support plate within the iron is reduced in a manner such that upon interruption of the supply of a heating current, cooling of the sole plate occurs sufficiently rapidly to allow the iron to remain on the pressing support without harming, as by scorching, this support or the fabric being ironed.

An additional object of the invention is to provide a pressing iron which permits an immediate production of steam even after a long period during which the iron has been in a stationary condition on its support.

The above and other objects are achieved, according to the invention, in an electric steam iron for pressing fabrics, which iron includes an ironing sole plate, electrically operated heating means disposed for heating the sole plate by converting an electric current to heat, and switch means for automatically reducing flow of electric current to the heating means when the iron is not in use, by the improvement wherein: the sole plate is formed to have a low heat capacity; and the iron further comprises a stiffening structure via which the sole plate is fixed in position in the iron, the stiffening structure being permeable to steam and being made of a thermally insulating material.

BRIEF DESCRIPTION OF THE DRAWING

Other features and advantages of the invention will become apparent from the following detailed description of preferred embodiments of the invention, presented with reference to the attached drawings, given by way of illustrative and non-limiting examples, in which.

DESCRIPTION OF THE PREFERRED EMBODIMENTS

Figure 1:
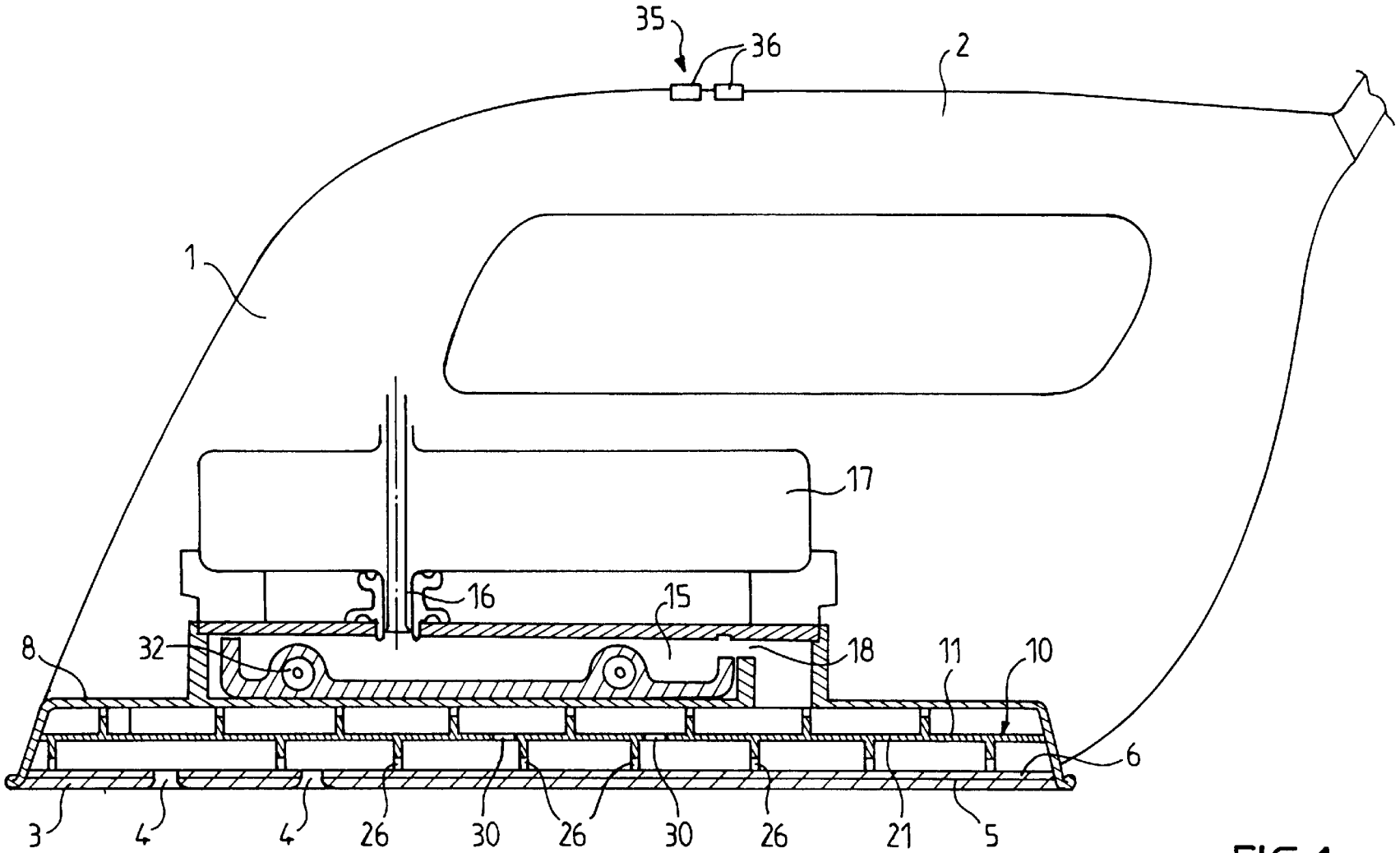
FIG. 1 is a side elevational view, partly in cross-section, of a pressing iron according to a preferred embodiment of the invention.

FIG. 1 is an elevational view generally showing, partly in cross section, the structure of an electric steam iron according to the invention, including an external envelope, shown in outline, commonly made of plastic material and forming a casing, or housing, 1. Casing 1 has an upper portion which is formed to provide a handle 2. The iron further includes a pressing sole plate 3 provided, according to preferred embodiments of the invention, with steam delivery orifices 4. Sole plate 3 is for example made of a material such as aluminum or a co-laminated aluminum-stainless steel material and is covered on its upper surface with a heating element 5 advantageously constructed, in the manner disclosed in French Patent No. 2686761 and a counterpart U.S. application Ser. No. 08/008,101, of one or several polymer films coating a heating resistance which is, for example, in the form of a flat ribbon of resistive material. In an advantageous manner, heating element 5 is flat, covers all, or substantially all, of the upper face of sole plate 3 and is secured thereto, for example by gluing, cementing, or bonding. According to one possible embodiment, the fixation of heating element 5 can be obtained by the addition of a support plate 6, for example of aluminum, at least partially covering, and preferably completely covering, heating element 5 and sole plate 3. Such an arrangement is particularly desirable when the pressing iron is provided with a steam generating chamber 15 capable of supplying steam, support plate 6 also providing, in this case, a fluid tight seal for heating element 5. For reasons of homogeneity of expansion and contraction, support plate 6 will advantageously be made of a material having a thermal behavior identical or close to that of the material constituting sole plate 3. According to a preferred embodiment, sole plate 3 and support plate 6 are made integral with one another or are fixed to one another by a fluid tight cover 8 which also delimits steam generating chamber 15.

According to another feature of the invention, it is particularly advantageous to assure at least in part the connection between support plate 6 and sole plate 3 by crimping sole plate 3 via orifices 4.

The thermal, or heat, capacity of sole plate 3 is made as small as possible and, for this purpose, its thickness will advantageously be between 0.4 and 1 mm, and preferably of the order of 0.6 mm, in order to permit it to be heated and cooled as rapidly as possible. The thermal capacity of the heating module formed by sole plate 3, heating element 5, and possibly support plate 6, is also reduced by reducing the thickness of support plate 6 to a value advantageously of the order of 0.2 mm, the total thickness of the module being in this example less than 2 mm and ideally of the order of 1 mm.

The rigidity of sole plate 3 is obtained by interposition, between sole plate 3 and the body of the iron, of a stiffening structure 10 made of a thermally insulating material which, in addition to its mechanical stiffening and support functions, assumes, on the one hand, a thermal isolation function and, on the other hand, a steam distribution function. First of all, stiffening structure 10 thermally isolates sole plate 3 in a manner to facilitate and accelerate the process of heating sole plate 3 given that essentially all of the thermal energy generated by heating element 5 drains, or flows, toward sole plate 3. Stiffening structure 10 is formed to be permeable to vapor. This permeability is assured by passages which assure the channeling of the steam toward orifices 4.

Figure 5:
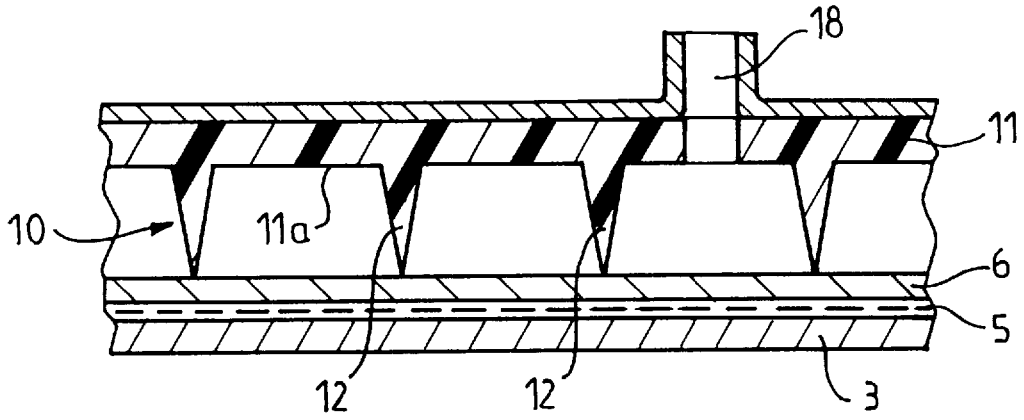
FIG. 5 is a detail cross-sectional view showing further details of a portion of a sole plate according to the invention.

According to a simple embodiment, stiffening structure 10 includes, as shown in FIG. 5, a plate 11 whose lower face 11*a* extends above, and at a distance from, sole plate 3 and is spaced therefrom by partitions 12. In preferred versions of the embodiment shown in FIGS. 1 and 5, steam generating chamber 15 communicates via a flow orifice 16 with a reservoir 17, on the one hand, and communicates via an outlet 18 with stiffening structure 10, on the other hand.

According to the embodiment shown in FIG. 5, partitions 12 are fixed to plate 11 and the lower extremities of partitions 12 rest on support plate 6 and define a series of flow passages.

Figure 3:
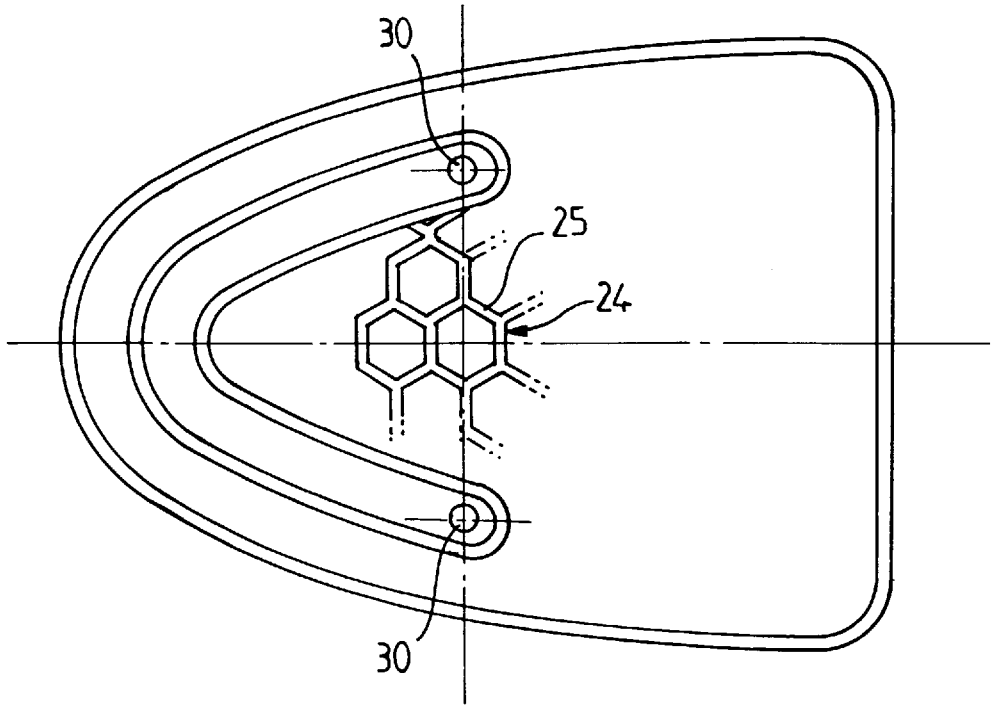
FIG. 3 is a top plan view showing portions of a sole plate according to the invention.
Figure 4:
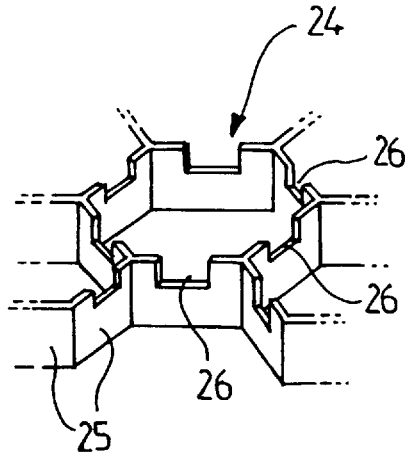
FIG. 4 is a perspective detail view of a component of a sole plate according to the present invention.

According to a preferred embodiment of the invention shown in FIG. 1, stiffening structure 10 is formed of a plate 21 which has a honeycomb structure that provides a plurality of cells 24, shown in greater detail in FIGS. 3 and 4. The walls 25 of cells 24 form partitions that extend between plate 21 and support plate 6. Advantageously, at least some, and preferably all, of cells 24 each communicates with each adjacent cell in a manner to assure a predetermined steam distribution across the totality of the surface of sole plate 3. As shown in FIG. 4, the communication between cells 24 can be obtained by providing holes or cutouts 26 in walls 25. According to a modified form of construction, it can also be envisioned to form walls 25 to have unequal heights, arranged along a specific path which permits the creation of one or several preferential flow passages for steam toward orifices 4. One thus obtains the desired permeability.

The stiffening structure 10 can provide a single level of cells in order to form a single layer structure, or, to the contrary, can be formed to provide a stack of several levels of cells. Thus, according to the preferred embodiment shown in FIG. 1, stiffening structure 10 is formed of two levels of cells 24 located at respectively opposite sides of plate 21, plate 21 forming a separation screen. The plate 21 is provided with perforations 30 which establish communication between the upper level and the lower level of cells 24. It is obviously possible to envision a stiffening structure 10 comprising a greater number of levels of cells 24.

In the embodiment shown in FIG. 3, stiffening structure 10 has a single level of cells 24 above which is a generally V-shaped distribution chamber that communicates with cells 24 via two perforations 30.

According to a preferred form of construction of the invention, the pressing iron is a steam iron such as shown in FIG. 1 and stiffening structure 10 serves as an interface between steam generating chamber 15 and orifices 4, while permitting a distribution of steam between the cells 24 of each level.

Figure 1A:
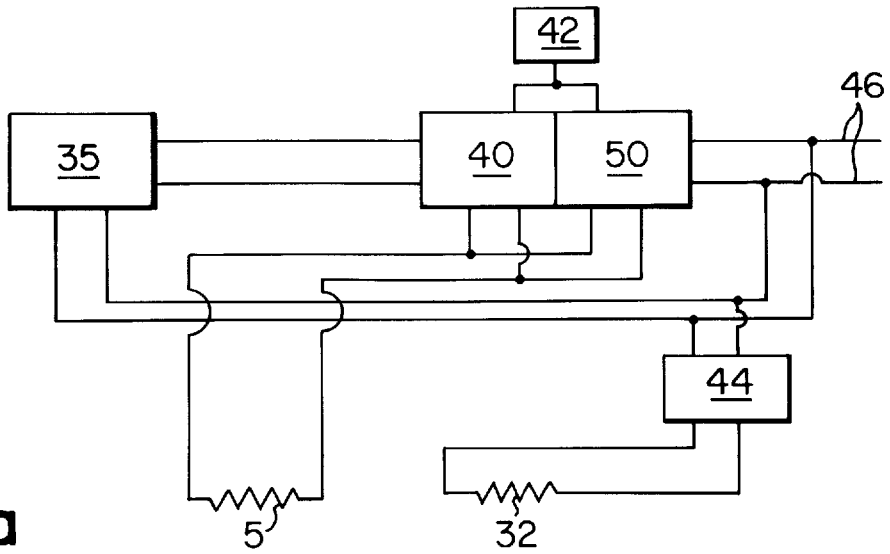
FIG. 1*a* is a block diagram showing the connection among switch elements, temperature controllers and a thermostat in the iron of FIG. 1.
Figure 2:
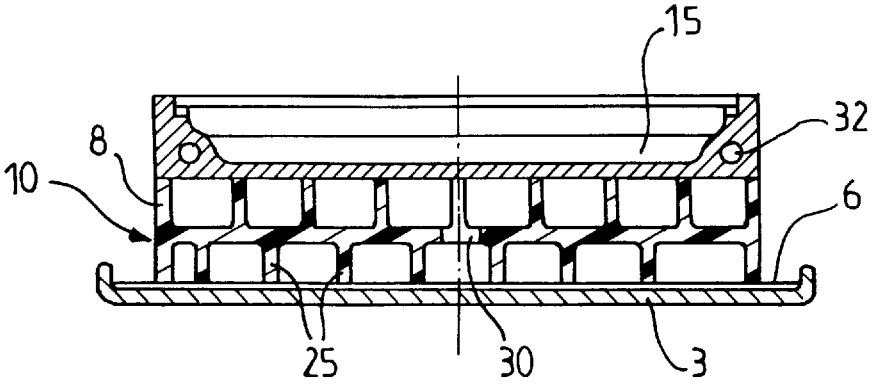
FIG. 2 is a cross-sectional elevational view showing details of a preferred embodiment of a sole plate according to the invention, FIG. 2 being in a vertical plane perpendicular to that of FIG. 1.

Referring to FIGS. 1 and 1*a*, the heating element 5 is, in a conventional manner, connected to a temperature limiter, or thermostat, 40, including a temperature sensor such as a thermocouple 42, which is adjustable by the user, for example by rotating a control button 40', and is connected to automatic switch means 35. The switch means 35 include a component for detecting the presence of a user, constituted for example of two bars, or strips, 36 incorporated into handle 2, bars 36 being connected in an electric circuit capable of controlling the connection and disconnection of heating element 5 with respect to a heating current source. The presence detector can correspond in all respects with that described in French Patent Application No. 9311624, the entire disclosure of which is incorporated herein by reference. A counterpart to that application was filed under the Patent Cooperation Treaty as PCT application 94 01111, and a copy thereof is submitted herewith. The bars 36 permit, when the user's hand seizes handle 2, creation of a low level leakage current which constitutes a signal indicating the presence of the user, resulting in the application of mains voltage across heating element 5 to thereby raise the temperature of sole plate 3. Inversely, when the detector no longer detects the presence of the user's hand, the supply of electricity to heating element 5 is immediately interrupted. The pressing iron also includes a second heating element 32 physically and operatively associated with steam generating chamber 15 and constituted for example of a sheathed heating resistance molded into a support piece. The second heating element 32 is connected electrically to a second temperature controller 44 independent of switch means 35. The independence of the second temperature controller permits second heating element 32 to continue operating in order to permanently maintain steam generating chamber 15 at an appropriate steam generating temperature even when switch means 35 are deactivated, i.e. when the user is not gripping handle 2 and a voltage is therefore not being applied to heating element 5. Such an electrical arrangement assures that when a pressing operation is resumed, a necessary and sufficient quantity of steam is immediately available for steam ironing.

The operation of the steam pressing iron according to the invention will be described below.

When the user grips handle 2, switch means 35 are activated and a voltage is applied, via conductors 46 of a power cord 48, switch means 35 and temperature limiter 40, to heating element 5 to assure that sole plate 3 will undergo a rapid temperature rise. When the assigned temperature that was previously selected by the user is achieved, temperature control of sole plate 3 is effectuated in a conventional manner. The temperature rise of sole plate 3 is rapid because of, on the one hand, its very low heat capacity resulting from its reduced thickness and, on the other hand, the thermally floating arrangement of sole plate 3.

Simultaneously, steam is produced in steam generating chamber 15 and the steam can then pass freely through stiffening structure 10 and the various perforations 30 connecting the levels of cells 24. The steam can equally be distributed regularly across the various cells 24 via cutouts 26 which are distributed either regularly or irregularly throughout the entire height of stiffening structure 10. During the course of a pressing cycle, or operation, stiffening structure 10 prevents any deformation of sole plate 3 despite the reduced thickness of sole plate 3. As soon as the user lets go of handle 2, the supply of electrical energy to heating element 5 is interrupted and because of the low thermal capacity of sole plate 3 and the rapidity of its reaction to the interruption of heating power, the iron can remain in a horizontal position and stationary on the ironing support upon which the iron was displaced during the ironing operation. In effect, tests have shown that with a substantially instantaneous interruption of heating power, sole plate 3 or the ironing module having a low heat capacity permits dissipation of thermal energy without the ironing support on which the iron rests being altered by scorching. The liberated heat energy is insufficient to cause any damage. The stiffening structure 10 assumes, in consequence, equally a fundamental function of thermal isolation resulting from a reduction of thermal bridges and a permeability in all directions in the volume which it defines.

When the user again grips handle 2, heating element 5 is activated almost instantaneously, by application of voltage thereto, without the user having to first either place the iron on its heel or place it flat in a particular location. It follows that necessary manipulations are particularly reduced.

According to an advantageous embodiment of the invention, heating of sole plate 3 is reactivated before its temperature drops to an unduly low value. The temperature of sole plate 3 is thus maintained at a value such that the ironing support can not be damaged. For a cotton flannel, or flannelette material, this minimum value can be around 100°–120° C. Thus, when use of the iron is resumed, it can reach its normal operating temperature within an even shorter time interval. This characteristic can be obtained by means of a thermostat having two temperature control values, the value corresponding to the higher temperature being, for example, adjusted by the user on the basis of the fabric to be ironed. To maintain the temperature of sole plate 3 at the lower, or standby value, temperature limiter 40 may include a second set of switch elements 50 which connect conductors 46 to heating element 5 when the sole plate temperature, as indicated by thermocouple 42, drops below the standby value. When handle 2 is being gripped by the user's hand and sole plate 3 is being heated to its operating temperature, switch elements 50 are open circuited.

An indirect advantage of the invention resides in the possibility of eliminating the necessity of having to design the heel of the iron to perform a stable support function, since the iron can always remain stationary in its ironing orientation when the user's hand is removed from handle 2.

Figure 6:
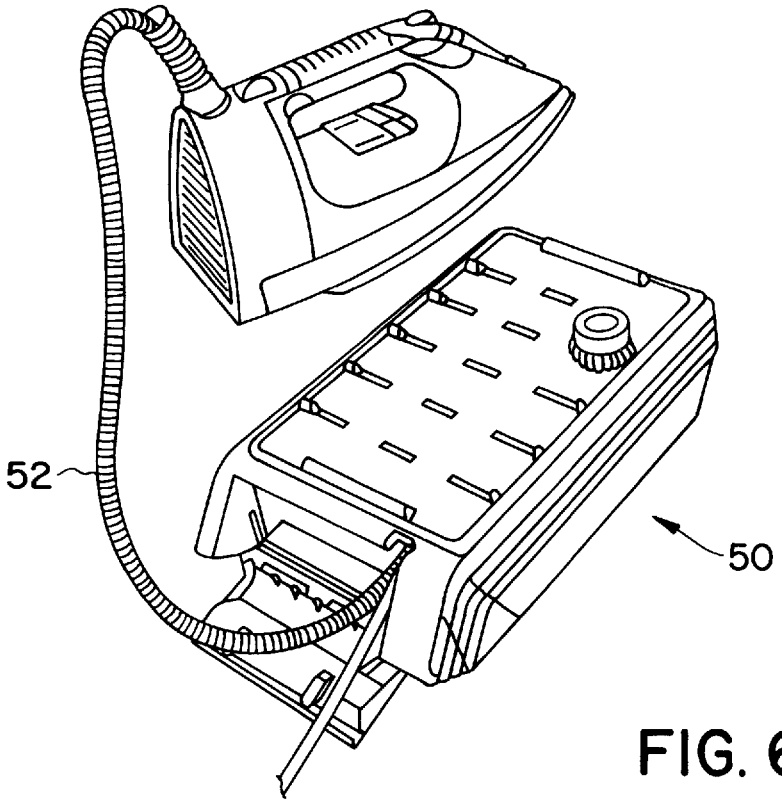
FIG. 6 is a perspective view of another embodiment of the invention.

According to another embodiment of the invention, shown in FIG. 6, the steam generating chamber 15 and the reservoir 17 of FIG. 1 may be replaced or supplemented by an external steam generator 50 connected to the iron via a steam delivery hose 52. Within the iron, steam delivered via hose 50 is conducted to stiffening structure 10.

This application relates to subject matter disclosed in French Application number 9313304, filed on Nov. 3, 1993, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. In an electric steam iron for pressing fabrics, which iron includes an ironing sole plate, electrically operated heating means disposed for heating the sole plate by converting an electric current to heat, and switch means for automatically reducing flow of electric current to the heating means when the iron is not in use, the improvement wherein:

said iron further comprises a stiffening structure for stiffening said sole plate, said sole plate is fixed in position in said iron via said stiffening structure, and said stiffening structure is permeable to steam and is made of a thermally insulating material.

2. The iron as defined in claim 1 further comprising a support plate at least partially covering said heating means and said sole plate.

3. The iron as defied in claim 2 wherein said sole plate, said heating means and said support plate together constitute an ironing module having a sufficiently low heat capacity to prevent scorching of a fabric in contact with said sole plate upon interruption of flow of electric current to said heating means.

4. The iron as defined in claim 3 in which said support plate is made of a material having thermal characteristics substantially identical to those of said sole plate.

5. The iron as defined in claim 3 in which said sole plate has a thickness of less than 1 mm and said module has a thickness of less than 2 mm.

6. The iron as defined in claim 2 wherein said heating means comprise a flat heating resistance covering said sole plate, said heating resistance being covered by said support plate.

7. The iron as defined in claim 1 wherein said stiffening structure comprises: a plate member having an upper face and a lower face, said lower face being disposed above, and spaced at a distance from, said sole plate and a plurality of partition walls extending from said lower face of said plate member toward said sole plate, and wherein said plate member and said partition walls are provided with passages for establishing fluid flow communication between said upper face and said lower face and across said partition walls.

8. The iron as defined in claim 7 in which said partition walls are fixed to said lower face of said plate member.

9. The iron as defined in claim 1 wherein said stiffening structure comprises a plurality of walls forming a honeycomb structure composed of a plurality of cells disposed adjacent one another and delimited by, and separated form one another by, said walls, wherein at least some of said cells are in fluid flow communication with cells immediately adjacent thereto.

10. The iron as defined in claim 9 wherein said stiffening structure forms a single level of said cells.

11. The iron as defined in claim 9 in which said stiffening structure comprises a plurality of levels of said cells, one level being disposed above the other, and said stiffening structure further comprises a plate member separating two of said levels of said cells from one another and forming a screen provided with perforation permitting fluid flow communication between said two levels of cells.

12. The iron as defined in claim 9 wherein at least some of said walls are provided with openings for creating the fluid flow communication between cells.

13. The iron as defined in claim 1 further comprising a steam generating chamber and wherein said sole plate is provided with steam outlet orifices and said stiffening structure defines fluid flow passages for placing said steam generating chamber in fluid flow communication with said orifices.

14. The iron as defined in claim 13, further comprising: a first temperature regulator connected to said switch means; second electrically operated heating means operatively associated with said steam generating chamber; and a second temperature regulator independent of said first temperature regulator and connected for controlling delivery of electric current to said second heating means.

15. The iron according to claim 1 in which said switch means comprise a detector for detecting the presence of a user, said detector being coupled in said switch means for interrupting flow of electric current to said heating means when the presence of the user is not detected.

16. The iron according to claim 15 having a handle to be gripped by the user, and in which said detector is an element for detecting contact of said handle by the user's hand, said detector being coupled functionally to said heating means.

17. The iron as defined in claim 1 wherein said switch means include a detector for detecting contact of a user's hand with said iron for supplying electric current to said heating means when the user's hand is in contact with said iron and for supplying a reduced level of electric current to said heating means for maintaining said sole plate at a reduced temperature when the user's hand is not in contact with the iron.

18. An iron as defined in claim 1 in combination with an external steam generator connected to said iron.

19. The iron as defined in claim 1 wherein said sole plate and said heating means together constitute an ironing module having a sufficiently low heat capacity to prevent scorching of a fabric in contact with said sole plate upon reduction, by said switch means, of flow of electric current to said heating means.

20. The iron as defined in claim 1 wherein said heating means are interposed between said sole plate and said stiffening structure.

21. An electric steam iron for pressing fabrics, said iron comprising:

an ironing module composed of an ironing sole plate and electrically operated heating means disposed for heating the sole plate by converting an electric current to heat;

switch means including a component for detecting the presence of a user for automatically reducing flow of electric current to the heating means when the iron is not in use; and a stiffening structure secured to said ironing module for stiffening said module and for fixing said ironing module in position in said iron, said stiffening structure being permeable to steam and being made of a thermally insulating material, wherein said ironing module has a sufficiently low heat capacity to prevent scorching of a fabric in contact with said sole plate upon interruption of flow of electric current to said heating means.

* * * * *